United States Patent [19]

Wehner

[11] Patent Number: 4,763,482

[45] Date of Patent: Aug. 16, 1988

[54] SWIRLER ARRANGEMENT FOR COMBUSTOR OF GAS TURBINE ENGINE

[75] Inventor: Edward J. Wehner, Cincinnati, Ohio

[73] Assignee: General Electric Company, Cincinnati, Ohio

[21] Appl. No.: 4

[22] Filed: Jan. 2, 1987

[51] Int. Cl.[4] ..... F02C 3/14; F23R 3/14

[52] U.S. Cl. ..... 60/746; 60/748

[58] Field of Search ..... 60/39.37, 748, 747, 60/39.31, 39.32, 39.36, 746; 239/406

[56] References Cited

U.S. PATENT DOCUMENTS

| | | | |
|---|---|---|---|
| 2,577,918 | 12/1951 | Rowe | 60/746 |
| 2,813,397 | 11/1957 | Fisher et al. | 60/39.32 |
| 3,000,183 | 9/1961 | Hall | 60/748 |
| 3,273,343 | 9/1966 | Cretella | 60/748 |
| 3,589,127 | 6/1971 | Kenworthy et al. | 60/39.37 |
| 3,869,246 | 3/1975 | Hammond, Jr. et al. | 60/748 |
| 4,525,996 | 7/1985 | Wright et al. | 60/39.31 |

FOREIGN PATENT DOCUMENTS 2085146 4/1982 United Kingdom .

*Primary Examiner*—Donald E. Stout

*Attorney, Agent, or Firm*—Derek P. Lawrence

[57] ABSTRACT

A gas turbine engine has an annular combustor structure which includes a plurality of annularly displaced combustion zones. A fuel nozzle is positioned in each combustion zone for supplying fuel thereto. A swirler is supported on each of the fuel nozzles and includes a plurality of angularly-directed passages for causing a swirling action of the air entering the combustion chamber through the nozzles. The swirlers are associated in pairs, each of the swirlers of each pair including a tab extending radially outwardly. When air is supplied through the angularly-directed passages, the swirlers are urged in a direction which brings the tabs of each pair into engagement with each other and thereby limits further rotational movement of the swirlers.

4 Claims, 2 Drawing Sheets

FIG. 2
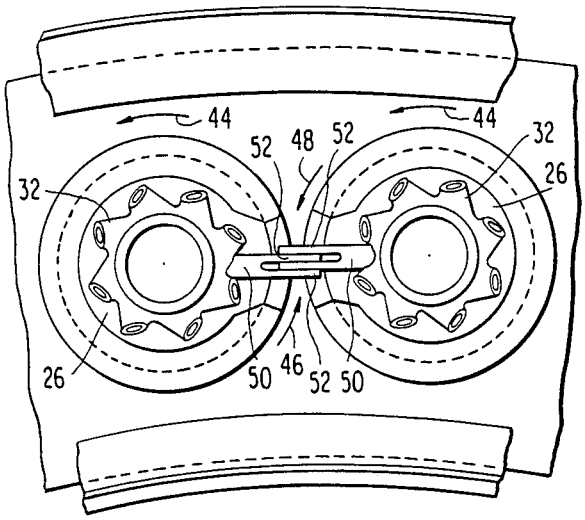
FIG. 3
PRIOR ART
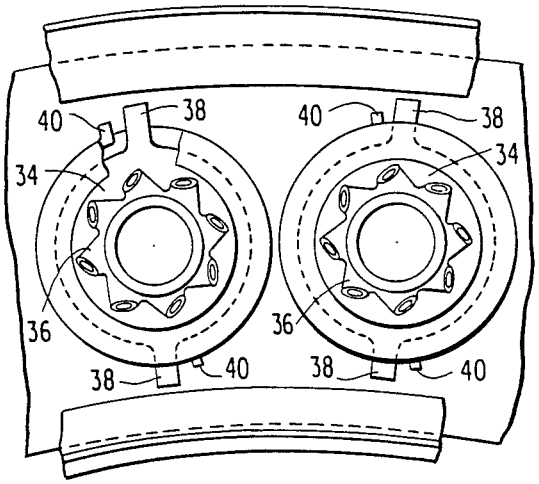
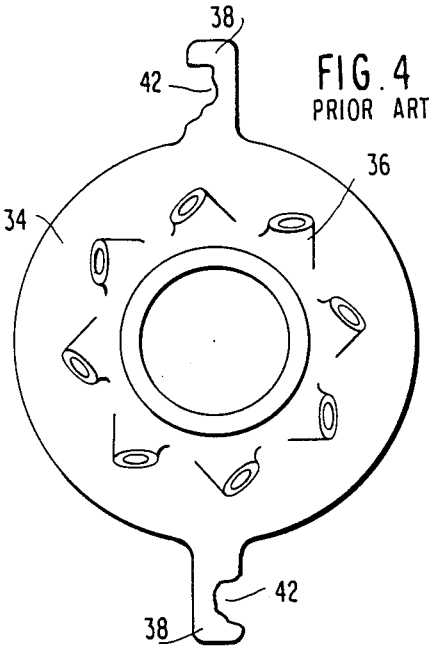
FIG. 4
PRIOR ART
FIG. 5
PRIOR ART
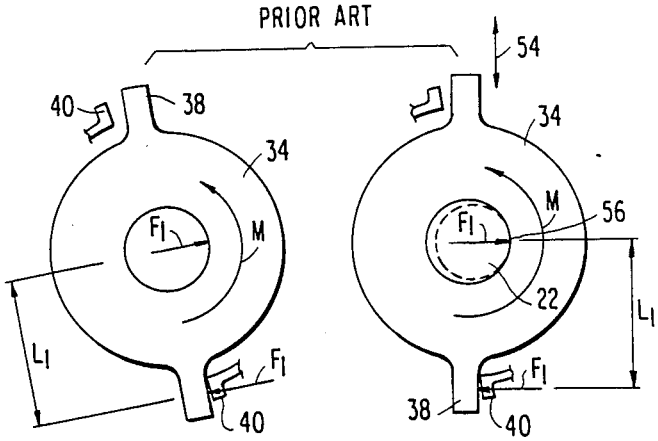
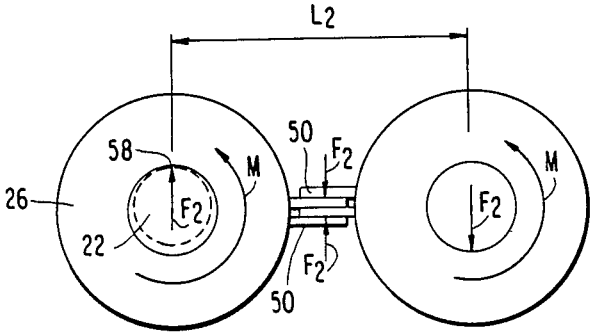
FIG. 6

SWIRLER ARRANGEMENT FOR COMBUSTOR OF GAS TURBINE ENGINE

BACKGROUND OF THE INVENTION

This invention relates to gas turbine engines, and more particularly, to swirler arrangements for supplying combustion air to the combustor of gas turbine engines.

Gas turbine engines include a combustor structure wherein fuel is burned to supply the necessary energy. To effect combustion fuel is supplied to a combustion zone and air is supplied in a manner to effect optimum mixing of the air and fuel for effective combustion. Usually the fuel is supplied through a fuel nozzle positioned at one end of the combustion zone and air is supplied through a surrounding swirler which imparts a swirling motion to the air so as to cause the air to be mixed thoroughly with the fuel.

In one conventional structure the swirler is provided with a plurality of angularly-directed passages which cause a swirling of the air within the combustion zone and thereby thorough mixing with the fuel. In this conventional structure the swirler is mounted on the fuel nozzle and includes a portion disposed in sliding engagement with a portion of the wall of the combustion zone. The air through the angularly-directed passages of the swirler tends to cause the swirler to rotate about its mounting on the fuel nozzle. In order that the swirler be enabled to provide the necessary swirling of the air and the effective mixing of the air and fuel, it is necessary that the rotation of the swirler be limited. In one conventional structure this is accomplished by providing a tab on the swirler and a stop on the combustor structure, the stop limiting the rotation of the swirler.

However, the combustor structure is vibrationally active and moreover there is substantial thermal expansion of components during operation of a gas turbine engine. As a result there is relative movement between the tab and the stop resulting in significant wear which eventually requires repair and increases maintenance costs.

By the present invention this problem of the prior art has been overcome and an arrangement for limiting the rotational movement of the swirlers has been provided in which the aforementioned wear is minimized.

It is an object of this invention to provide a combustor structure for a gas turbine engine including swirlers associated with fuel nozzles and including a stop arrangement for limiting rotation of the swirlers in a manner which minimizes wear and thereby reduces maintenance.

SUMMARY OF THE INVENTION

In carrying out the invention, in one form thereof, a gas turbine engine has an annular combustor structure which includes a plurality of annularly displaced combustion zones. A fuel nozzle is positioned in each combustion zone for supplying fuel thereto. A swirler is supported on each of the fuel nozzles and includes a plurality of angularly directed passages for causing a swirling action of the air entering the combustion zone, thereby providing a thorough mixing of the air with the fuel. In order to limit the rotation of the swirlers the swirlers are associated in pairs, each of the swirlers of each pair including a tab extending radially outwardly. When air is supplied through the angularly directed passages the swirlers are urged in a direction which brings the tabs of each pair into engagement with each other and thereby limits further rotational movement of the swirlers.

BRIEF DESCRIPTION OF THE DRAWINGS

In the drawings

FIG. 2 is a view, partly broken away, of a portion of an annular combustor structure, showing paired swirlers made in accordance with the present invention.

FIG. 3 is a view corresponding to FIG. 2 showing a prior art structure.

FIG. 4 is a view of a prior art swirler illustrating the wear involved.

FIG. 5 is a schematic diagram illustrating the forces acting on the swirler structure of the prior art.

FIG. 6 is a schematic diagram illustrating the forces acting on the swirler structure of this invention.

DESCRIPTION OF THE PREFERRED EMBODIMENT

Figure 1:
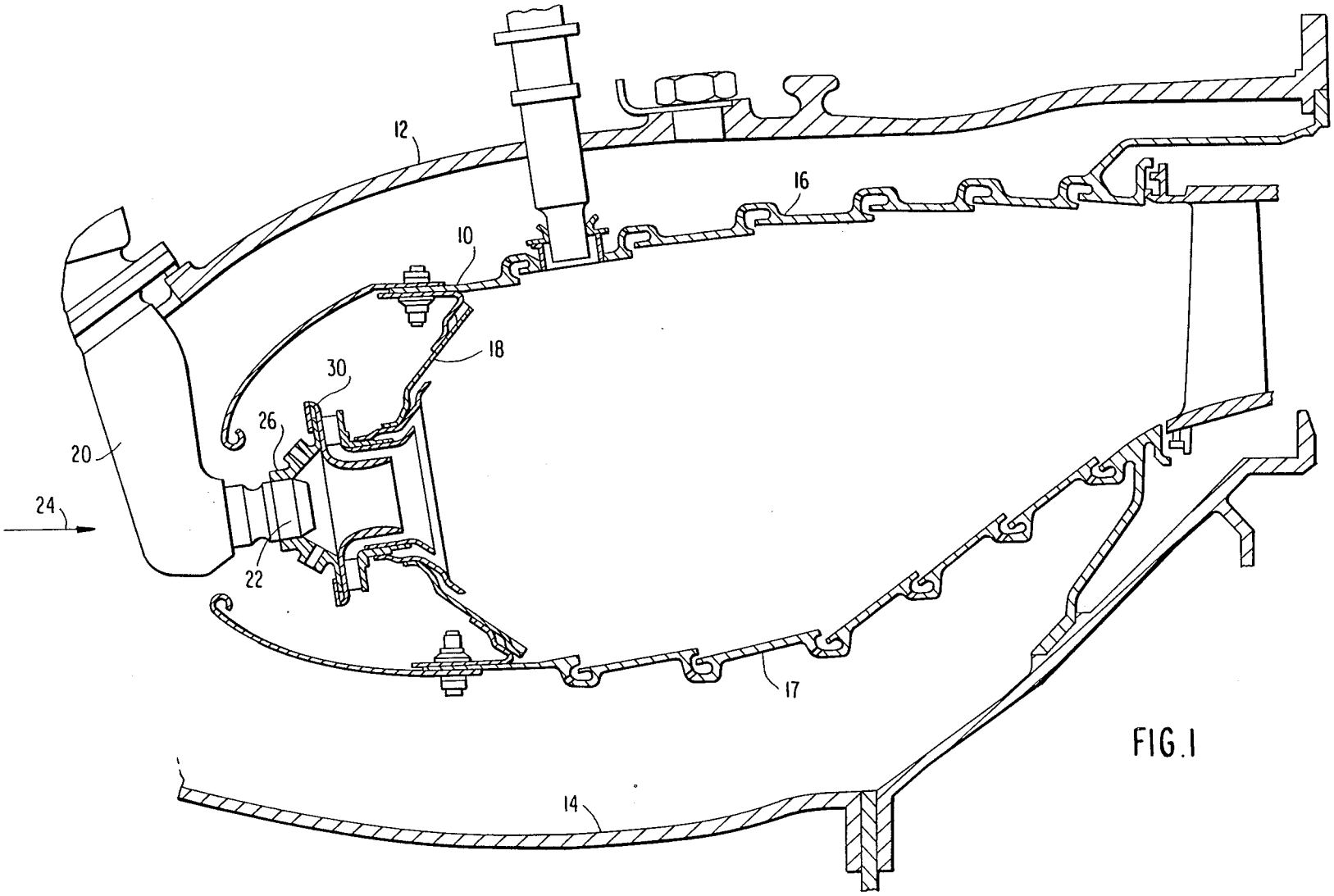
FIG. 1 is a sectional view of a combustor structure showing the general arrangment of the components thereof.

FIG. 1 is a view of one combustion zone of the plurality of combustion zones employed in the gas turbine engine of this invention. The combustor structure of this invention is annular and the combustion zones, one of which is illustrated at 10 in FIG. 1, are arranged in annularly displaced relationship in the annular combustor structure. In the specific embodiment of this invention thirty such combustion zones are employed in the combustor structure.

Referring to FIG. 1 the gas turbine engine includes walls 12 and 14 which form the annular combustor support structure. The combustion zones, one of which is shown at 10 in FIG. 1, are positioned in annularly displaced relationship within the combustor structure. Each combustion zone includes an annular liner 16, an annular liner 17 and an annular member 18.

To provide fuel for the combustion zone a nozzle structure 20 is supported on the wall 12. This nozzle structure 20 terminates in a nozzle 22 through which fuel is supplied to the combustion zone.

Combustion air for burning the fuel is provided from a compressor (not shown) of the gas turbine engine in the direction of the arrow 24. In order to direct this air in a swirling fashion into the combustion zone and thereby to effect thorough mixing of the air with the fuel from the nozzle 22, a swirler 26 is provided. The swirler is mounted on the fuel nozzle 22 and is further supported by a member 30.

As described previously, the gas turbine engine includes a plurality of such combustion zones arranged in annularly displaced fashion throughout the full annular extent of the combustor structure. In a specific embodiment of this invention thirty such combustion zones, each including a swirler 26, are provided in the combustor structure. In accordance with this invention, as explained in further detail below, the thirty swirlers involved with the thirty combustion zones are arranged in pairs, that is, there are fifteen such pairs in the overall structure.

Referring now to FIG. 2, each of the swirlers 26 includes a plurality of angularly-directed nozzles 32 for directing the combustion air into the corresponding combustion zone in a swirling manner to effect thorough mixing of the air and the fuel. Because of the angular direction of the passages 32, the air being directed through these passages tends to cause both of the swirlers shown in FIG. 2 to rotate in a counterclockwise direction, as viewed in FIG. 2.

The prior art swirlers shown in FIG. 3 are correspondingly arranged in an annularly displaced manner within the annular combustor structure. These prior art swirlers 34 include a plurality of angularly-directed passages 36 corresponding to the passages 32 in the embodiment shown in FIG. 2. Thus the prior art swirlers shown in FIG. 3 also tend to rotate in a counterclockwise direction under influence of the air passing through the angularly-directed passages 36. In order to limit such rotational movement and thereby to insure that the air is directed into the combustion chamber in a manner which achieves the necessary swirling action, the prior art swirlers 34 in FIG. 3 are formed to include two diametrically extending tabs 38. The combustor structure is formed to include stationary stops 40, each of which is positioned to be engaged by a corresponding tab 38 to limit the rotation of the swirlers 34.

However, the combustor structure of a gas turbine engine is vibrationally active. Moreover thermal expansion of the components of the overall structure occurs during operation of the gas turbine engine. As a result, there is relative radial movement of the tabs 38 and the stops 40. Since the tabs 38 are urged with significant force against the stops 40, this relative radial movement causes wear on the tabs 38 of the swirlers 34, eventually requiring replacement of the swirlers and adding to the maintenance cost of the gas turbine engine. The wear involved is illustrated at 42 in FIG. 4.

By the present invention the problem of wear of the stops has been eliminated by eliminating the stops themselves and accomplishing the necessary limiting of the rotation of the swirlers by means of an engaging relationship of tabs on adjacent swirlers of each pair of swirlers. As indicated above, in accordance with the present invention, the swirlers are arranged in pairs of adjacent swirlers. Thus, in an embodiment of the invention employing thirty combustion zones arranged around the annular combustor structure, fifteen such pairs of swirlers are employed. One of these pairs is illustrated in FIG. 2.

Applicant takes advantage of the rotational relationship of adjacent swirlers of the pair. Thus, as illustrated in FIG. 2, each of the swirlers 26, under the influence of air passing through the angularly-directed passages 32, has a rotational force imparted thereto in the direction of the arrows 44. Thus, in the embodiment shown in FIG. 2 both the swirlers 26 there illustrated have a rotational force exerted thereon tending to move the swirlers in a counterclockwise direction. This means that at the adjacent area of the swirlers the periphery of the left-hand swirler 26 tends to move in an upward direction, indicated by the arrow 46. At the same time the adjacent periphery of the right-hand swirler 26 tends to move in a downward direction indicated by the arrow 48.

Applicant takes advantage of this relationship by making each of the swirlers to include a radially extending tab 50. In the specific embodiment shown each tab 50 is made in bifurcated form including two fingers 52. The fingers 52 of the tabs 50 are arranged, as shown in FIG. 2, to interlock. Since the swirlers 26 are all identical in construction and are supplied from a common source of air, the rotational forces exerted on each swirler are substantially identical and the opposing forces referred to above are therefore substantially equal. Since, therefore, the opposing forces in the direction of the arrows 46, 48 balance each other, the swirlers of each pair are thereby prevented from rotating.

By the applicant's construction the prior art problem, involving engagement between a tab on a swirler and a stop on the vibrationally active combustor structure, wherein the relative movement of the stop and tab resulted in wear of the stop, is avoided. Further the construction is simplified since the applicant's structure requires only a single tab on each swirler and the separate stops on the combustor structure, are completely eliminated. In the applicant's arrangement the swirlers are free to move radially and circumferentially relative to the fuel nozzles to accommodate assembly and operational variations. The radial movement is illustrated in somewhat exaggerated form by the dashed lines in FIG. 6.

While, in the preferred embodiment illustrated in FIG. 2, each of the tabs is made in bifurcated form with two fingers 52 and the fingers of the adjacent tabs are arranged to interlock as shown, each of the tabs could be made, if desired, as a single radially extending arm, the arms of adjacent tabs simply abutting, rather than interlocking.

In FIGS. 5 and 6 the coupling forces exerted by the rotational force applied to the swirlers are illustrated. Referring to FIG. 5, which shows the prior art construction, a force $F_1$ is exerted at the points shown. The magnitude of this force is given by the relationship $$F_1 = \frac{M}{L_1}$$

where M = moment and $L_1$ = the distance between the points of application of the force $F_1$.

Referring now to FIG. 6 where the relationship of forces in the structure of the present invention is shown, the force $F_2$ exerted in the direction of the arrows illustrated in FIG. 6 is given by the formula $$F_2 = \frac{2M}{L_2}$$

where $L_2$ = the distance between the points of application of force on the fuel rods and the associated swirlers. $L_2 \cong 2L_1$ and $F_2 \cong F_1$.

In the prior art structure, the resultant force $F_1$ was exerted in a circumferential direction, as illustrated in FIG. 5. However, the combustor structure tends to move in a radial direction, as indicated by the arrows 54 in FIG. 5. This resulted in some relative sliding movement in the area 56 between the nozzle 22 and the swirler mounted thereon, thus causing wear in the area 56. In the force relationships of the applicant's invention, as illustrated in FIG. 6, however, the resultant force $F_2$ is exerted in a radial direction. Since the combustor structure also tends to move in a radial direction, there is no relative sliding movement in the area 58 between the full nozzle and the swirlers mounted thereon, thus removing another source of potential wear.

By the present invention a simplified arrangement for preventing rotation of the swirlers is provided. The stops employed in the prior art structure are eliminated and this source of wear is correspondingly eliminated, reducing the maintenance required for the gas turbine engine.

It is claimed:

1. Combustion apparatus for a gas turbine engine comprising:

(a) an annular combustor structure including a plurality of annularly displaced combustion zones;

(b) a fuel nozzle extending into each of said combustion zones for supplying fuel to said combustion zones;

(c) a swirler supported on each fuel nozzle, each of said swirlers including a plurality of angularly-directed passages for directing combustion air to provide effective mixing of the air with the fuel, the air flowing through said passages tending to rotate each of said swirlers in the same rotational direction;

(d) said swirlers being arranged in adjacent pairs; and (e) means on each of said swirlers for engaging said means on the adjacent swirler to limit rotation of said swirlers.

2. Combustion apparatus for a gas turbine engine comprising:

(a) an annular combustor structure including a plurality of annularly displaced combustion zones;

(b) a fuel nozzle extending into each of said combustion zones for supplying fuel to said combustion zones;

(c) a swirler supported on each fuel nozzle, each of said swirlers including a plurality of angularly-directed passages for directing combustion air to provide effective mixing of the air with the fuel, the air flowing through said passages tending to rotate each of said swirlers in the same rotational direction;

(d) each of said swirlers including a radially extending tab;

(e) said plurality of swirlers being arranged in adjacent pairs, the tabs of the swirlers of each pair being positioned for engagement with each other and being urged against each other by the rotational force imparted to the swirlers of each pair, whereby said engaging tabs of each pair act as mutual stops for limiting rotation of said swirlers.

3. The combustion apparatus as recited in claim 2 wherein each of said tabs comprises a pair of spaced fingers, the fingers of one swirler of each pair interlocking with the fingers of the other swirler of said pair.

4. The combustion apparatus as recited in claim 2 wherein each of said tabs comprises an arm extending radially from each swirler, said arms of each pair of swirlers engaging each other in abutting relationship to limit rotation of said swirlers.

* * * * *